US005437235A

United States Patent [19]

Randolph

[11] Patent Number: 5,437,235

[45] Date of Patent: Aug. 1, 1995

[54] COMPUTER WORK STATION

[75] Inventor: Travis M. Randolph, Saugatuck, Mich.

[73] Assignee: Symbiote, Inc., Holland, Mich.

[21] Appl. No.: 75,051

[22] Filed: Jun. 10, 1993

[51] Int. Cl.[6] ..... A47B 85/00

[52] U.S. Cl. ..... 108/25; 312/196; 312/223.3

[58] Field of Search ..... 312/223.3, 208.1, 194, 312/196; 108/25, 96, 145, 84

[56] References Cited

U.S. PATENT DOCUMENTS

| | | | |
|---|---|---|---|
| 1,704,892 | 3/1922 | Hardy . | |
| 1,923,969 | 6/1930 | Chase . | |
| 2,230,444 | 4/1939 | Balster . | |
| 2,738,248 | 3/1956 | Berker | 312/208.5 |
| 3,404,930 | 6/1967 | Cafiero et al. . | |
| 3,696,760 | 10/1972 | Riley . | |
| 4,372,629 | 2/1983 | Propst . | |
| 4,438,458 | 3/1984 | Munscher . | |
| 4,654,756 | 3/1987 | Wilson et al. . | |
| 4,691,888 | 9/1987 | Cotterill . | |
| 4,695,104 | 9/1987 | Lederman . | |
| 4,706,919 | 11/1987 | Soberalski . | |
| 4,709,972 | 12/1987 | LaBudde et al. . | |
| 4,725,106 | 2/1988 | Shields . | |
| 4,734,826 | 3/1988 | Wilson et al. . | |
| 4,747,788 | 5/1988 | Byrne . | |
| 4,766,422 | 8/1988 | Wolters et al. . | |
| 4,781,126 | 11/1988 | Lochridge . | |
| 4,828,342 | 5/1989 | Stefan | 312/223.3 |
| 4,852,500 | 8/1989 | Ryburg et al. . | |
| 5,031,867 | 8/1991 | Cotterill . | |
| 5,041,770 | 8/1991 | Seiler et al. . | |
| 5,101,736 | 4/1992 | Bommarito et al. . | |
| 5,125,727 | 6/1932 | Lechman et al. . | |

FOREIGN PATENT DOCUMENTS

| | | | |
|---|---|---|---|
| 4200965 | 7/1992 | Germany | 312/223.3 |
| 0659370 | 1/1987 | Switzerland | 312/223.3 |
| 0617068 | 7/1978 | U.S.S.R. | 312/196 |

*Primary Examiner*—Kenneth J. Dorner
*Assistant Examiner*—Gerald A. Anderson
*Attorney, Agent, or Firm*—Waters & Morse

[57] ABSTRACT

A computer work station comprises a fixed position work surface having an enlarged monitor opening therein, a recessed component support pan attached to the work surface under the monitor opening, and a raisable monitor support mechanism mounted in the component pan that supports the monitor platform. The monitor lift mechanism is an extendable folding frame that is counterbalanced with a spring mechanism to offset the weight of the monitor such that the monitor can be raised or lowered simply by lifting or lowering the monitor platform manually, with the monitor remaining in place after its position has been adjusted. The component pan provides a recessed support and storage space for the monitor and other components. An adjustable work surface is mounted at the front of the fixed work surface by means of an adjustable mounting mechanism located in the pan and having cantilever arms extending out of the pan. A separate docking station can be provided for a lap top computer.

23 Claims, 11 Drawing Sheets

COMPUTER WORK STATION

BACKGROUND OF THE INVENTION

The present invention relates to computer work stations and more particularly to a computer work station having a manually adjustable monitor platform and work surface.

The widespread use of computers in office applications has given rise to a new generation of office furniture. This furniture is designed to accommodate and provide positioning flexibility for desk top computers and the wiring for the computers. Some mechanisms provide for keyboard adjustment, while other mechanisms provide for monitor adjustment, and still other mechanisms provide other types of adjustments. Many such adjustments are so complicated and expensive that they can be used only in high cost computer furniture.

An object of the present invention is to provide an improved computer work station that includes a component support pan below a work surface, with an adjustable height monitor platform and an adjustable height work surface or keyboard platform mounted in the pan, such that the system is relatively simple and inexpensive and yet provides ample component storage capabilities and a wide range of adjustment that is simple to accomplish by lifting and lowering the mechanisms to the height desired.

SUMMARY OF THE INVENTION

In accordance with the present invention, a computer work station comprises a fixed position work surface having an enlarged opening therein through which a computer monitor may pass. A recessed component support pan is attached to the work surface under monitor opening. A raisable monitor support mechanism is mounted in the component pan and extends upwardly to support monitor platform positioned over the monitor opening. A monitor mounted on the monitor platform is raised or lowered to a position above the plane of the work surface or a position at least partially below the plane of the work surface by adjustment of the monitor lift mechanism.

The monitor lift mechanism is an extendable folding frame that is counterbalanced with a spring mechanism to offset the weight of the monitor such that the monitor can be raised or lowered simply by lifting or lowering the monitor platform manually, with the monitor remaining in place after its position has been adjusted.

The component pan is an integrally formed unit made of sheet metal or the like that is mounted on the underside of the fixed work surface. The component pan provides a recessed support and storage space for the monitor and other components, while at the same time providing reinforcement for the edges of the work surface surrounding the monitor opening. The component pan has relatively deep side walls and a recessed bottom, providing ample space for mounting communication terminals electrical outlets computers and expansion chasses and other electronic and mechanical components in an out-of-sight position below the table top while at the same time providing these components in a location where they can be easily accessed and utilized in connection with a computer application. The pan also can incorporate a mounting mechanism for mounting an adjustable work surface at the front edge of the fixed work surface. A mechanically movable hinge mechanism, preferably spring counterbalanced is mounted in the interior of the monitor support pan and support linkage extends through openings in the pan to a work surface supporting position outside the pan. A movable work surface is mounted to the linkage and can be raised and lowered simply by lifting and lowering the work surface to the position desired. A lock mechanism locks the work surface in its desired position. The work surface can be an enlarged desk top type of work surface or it can be merely a keyboard support platform. Incorporating the structure of the movable work surface support mechanism in the interior of the monitor platform provides rigid support for the movable work surface while at the same time concealing pinch points and other movable apparatus in an out of way position These and other advantages of the present invention are described in more detail in connection with preferred embodiments of the present invention which are described below and shown in the attached drawings.

BRIEF DESCRIPTION OF DRAWINGS

FIG. 10 is a sectional side elevational view taken along line 10—10 of FIG. 5.

DETAILED DESCRIPTION OF PREFERRED EMBODIMENTS

Figure 1:
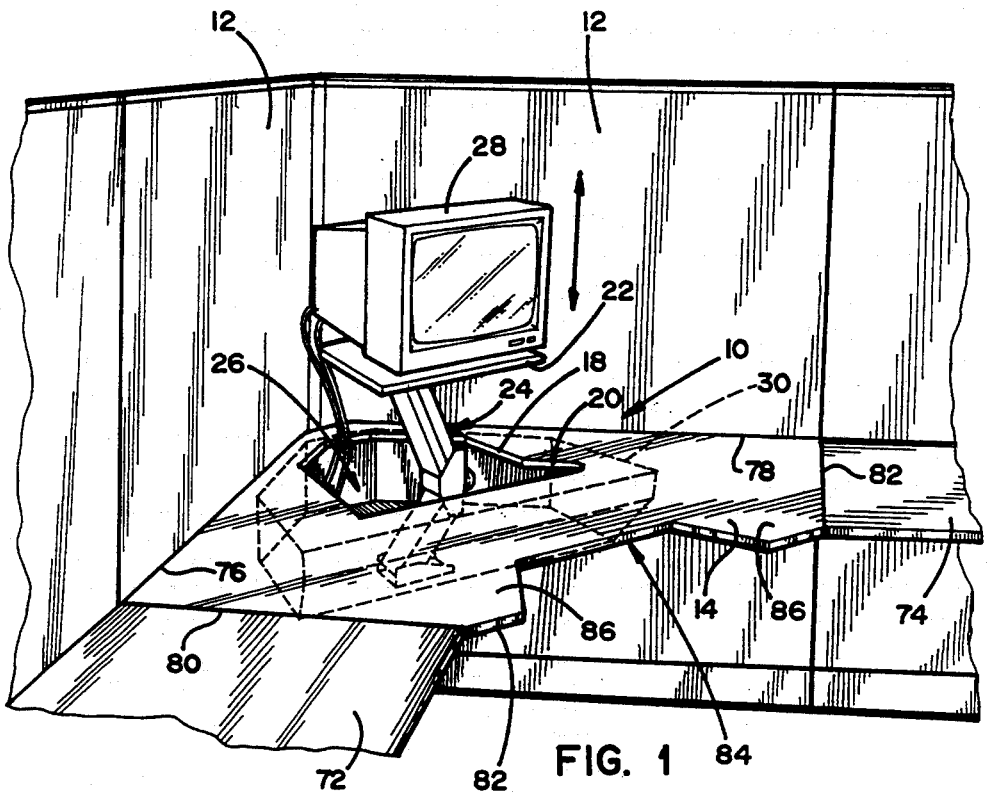
FIG. 1 is a pictorial perspective view showing a computer work station constructed in accordance with the present invention a fixed table top work surface.
Figure 18:
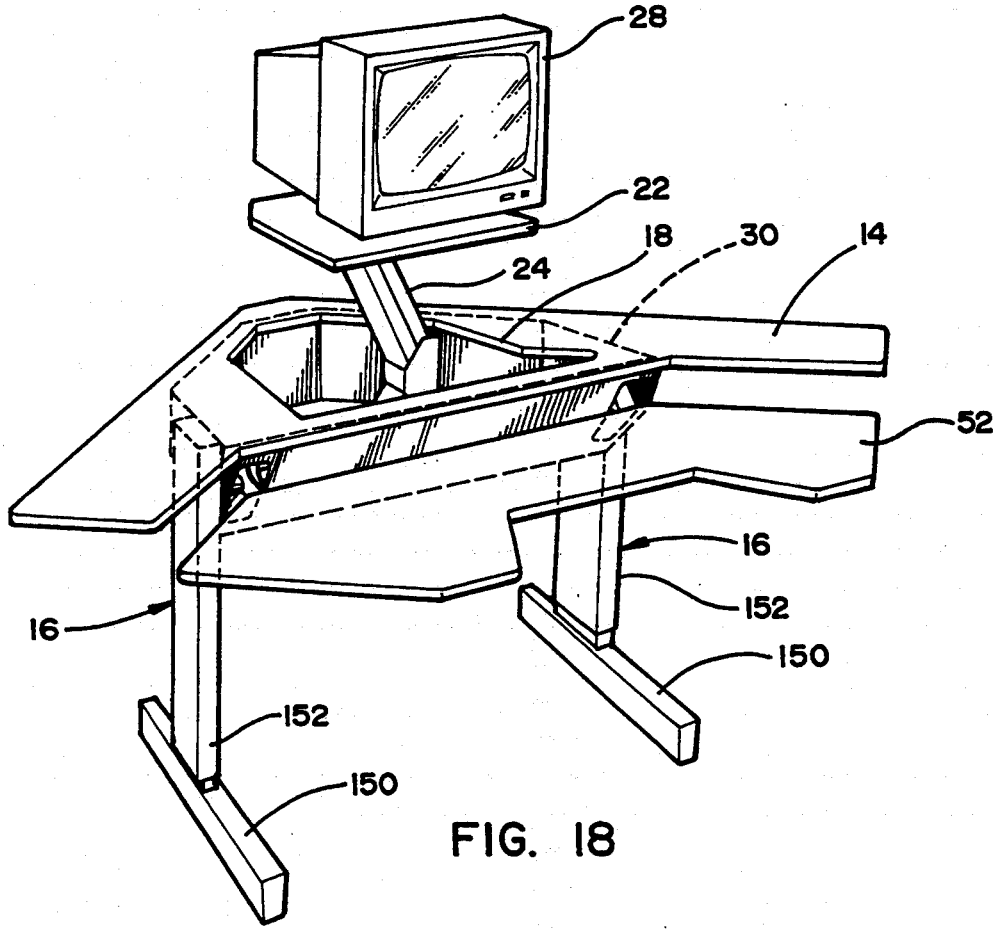
FIG. 18 is a perspective view of a corner work station of the type shown in FIG. 1 wherein the work station is mounted on telescoping legs instead of on a wall panel system.
Figure 19:
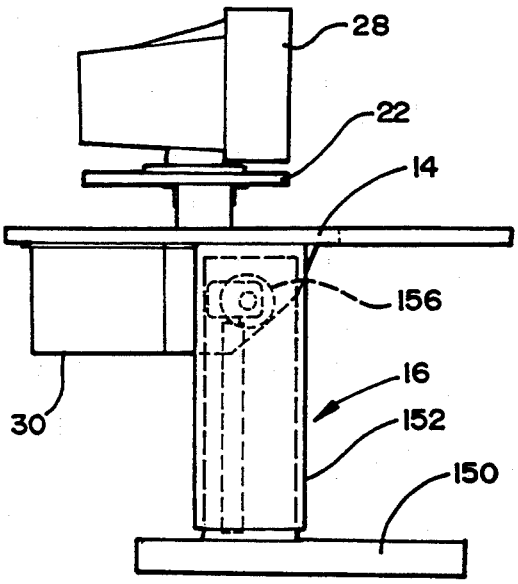
FIG. 19 is a side elevational view of the embodiment shown in FIG. 18.
Figure 20:
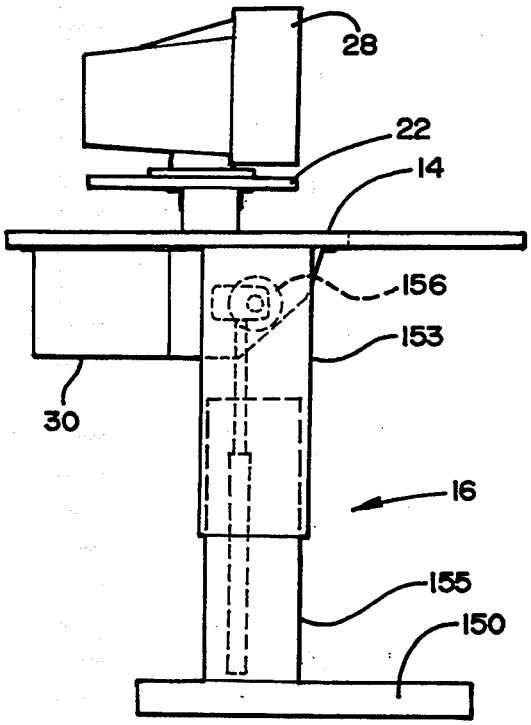
FIG. 20 is a side elevational view of the embodiment of FIGS. 18 and 19, showing the legs in an extended position.

Referring now to the drawings, a computer work station 10 designed to fit in a corner and supported on free standing panels 12 of an open office wall panel system is shown in FIG. 1. Work station 10 comprises a generally horizontal work surface 14 that is mounted in a fixed position in this embodiment on wall panels 12 by conventional support means. Work surface 14 may also be supported on telescoping legs 16 as shown in FIGS. 18–20. Work surface 14 nonetheless is referred to a the "fixed" work surface.

Figure 6:
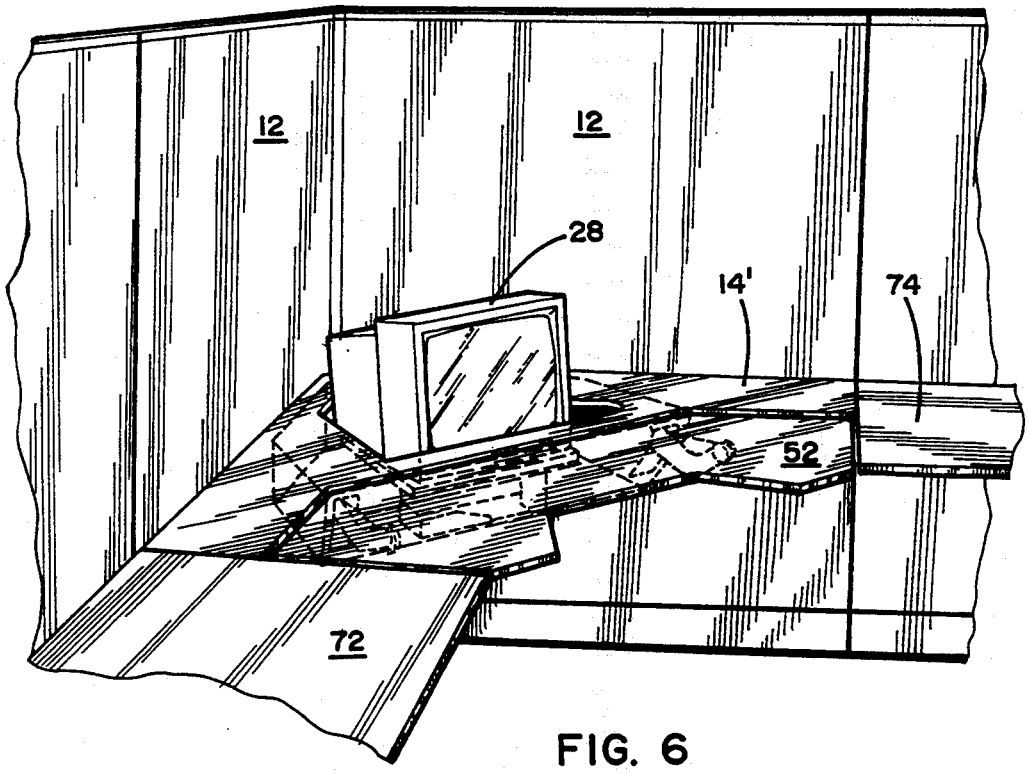
FIG. 6 is a pictorial perspective view of the embodiment shown in FIG. 3, wherein the monitor is adjusted to a vertical height wherein the monitor platform and a portion of the monitor are recessed downwardly in the interior of the component pan, such that the lower edge of the monitor screen is positioned at desk top level.

Work surface 14 has an enlarged monitor opening 18 formed in a rear portion of the work surface. Monitor opening 18 is generally rectangular in shape with a truncate triangular rear portion that extends toward the rear corner of the work surface. Monitor opening 18 is sufficiently large to have a computer monitor fit downwardly within the monitor opening as shown in FIG. 6. The monitor opening has an outwardly cut away portion 20 at the front right edge thereof (FIG. 1 orientation) which permits improved access to the interior portion of the chamber below the monitor opening.

A monitor support platform 22 is shaped to fit into monitor opening 18, with the outer configuration of monitor platform 22 being substantially the same as monitor opening 18 with the exception of recess 20 which is left open for access into the interior of the monitor support chamber. There may be a gap between the outer edge of the monitor support platform and the periphery of opening 18 if desired.

Monitor support platform 22 is mounted on a monitor lift mechanism 24 which is mounted in the interior 26 of the pan Monitor lift mechanism 24 is height adjustable so that the vertical height of a monitor 28 positioned on monitor platform 22 can be adjusted from a raised position shown in FIG. 1 to a lowered position shown in FIG. 6.

A component support pan 30 (shown in phantom in FIG. 1 and in detail in FIG. 14) is mounted on the underside of fixed work surface 14. Pan 30 desirably is formed of stamped sheet metal so as to provide a rigid support structure for supporting the monitor and reinforcing the fixed work surface as well as providing a support structure for an adjustable work surface which is described below.

Figure 14:
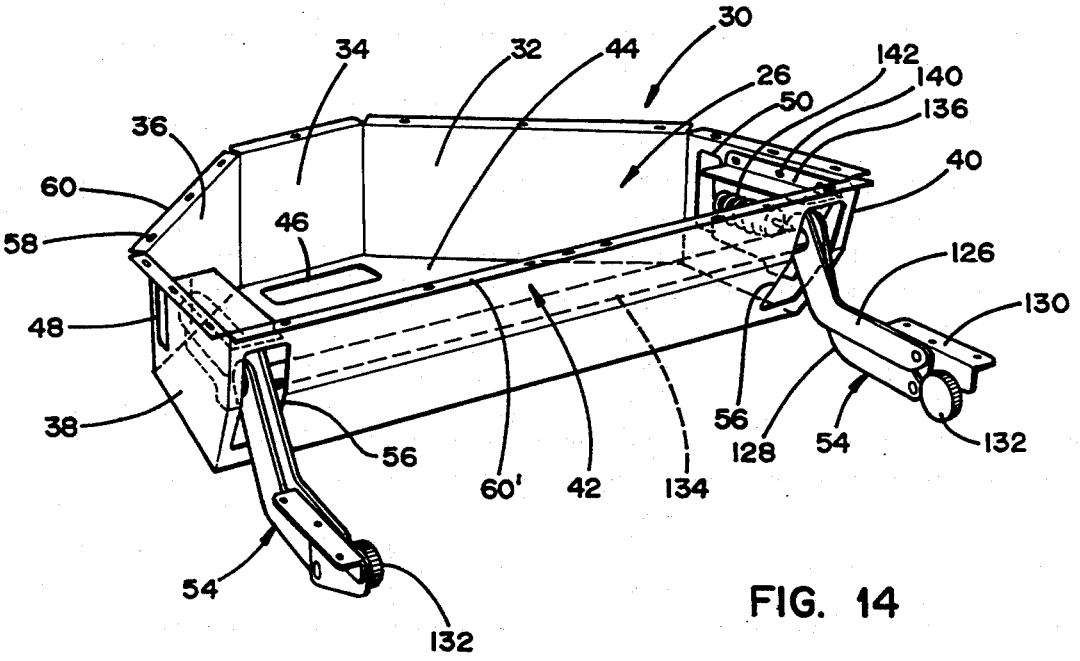
FIG. 14 is a perspective view of the corner mounted component pan of FIG. 13.

Referring to FIG. 14 component support pan 30 comprises downwardly extending sidewalls 32 34 36, 38 40 and 42 which are connected to form a continuous sidewall structure A bottom 44 encloses bottom edges of the sidewalls and provides a base for supporting the monitor support apparatus. Bottom 44 has an opening 46 at the rear edge thereof for wiring access to chamber 26 forming the interior of the component support pan. Openings 48 and 50 respectively in sidewalls 38 and 40 provide wiring access to the interior of the component support pan through the sidewalls of the pan.

In the FIG. 1 embodiment the front wall 42 of the pan is closed. In the embodiments shown in FIGS. 3 and 4, however, the component support pan also supports an adjustable work surface 52 by means of cantilever support brackets 54 (shown in FIG. 14). These brackets extend through openings 56 positioned at the outer sides of front panel 42 and extend inwardly into the interior of the component support pang where they are mounted to the sides 38 and 40 of the component support pan. The component support pan is attached to the underside of the fixed work surface 14 immediately below monitor opening 18 by means of fasteners such as screws or the like that extend through openings 58 in horizontal mounting flanges 60 that extend outwardly from the upper ends of the sidewalls of the component support pan (see FIG. 14). It should be noted that the profile of the component support pan is substantially larger than the monitor opening 18 and fixed work surface 14 This provides additional room in the component support pan for housing electronic components (see FIGS. 21 and 23, for example) and provides additional space for the incorporation of the support mechanism for adjustable work surface 52 in the interior of the component support pan. By incorporating the support mechanism for the adjustable work surface in the interior of the component support pan, the mechanism can be placed conveniently out of the way in a concealed position, while at the same time providing a structural mounting for an adjustable work surface that is rigid.

Moving members that need to have protected pinch points and the like are all incorporated out of the way and out of access of the user in the interior of the component support pan. A component support pan having a support mechanism for an adjustable work surface integrally mounted in the interior of the support pan provides an important advantage for the present invention.

In addition to providing a chamber for storing electrical equipment as well as a recessed support platform for the monitor and a rigid sidewall mounting structure for the adjustable work surface the mounting platform also provides an important reinforcement mechanism for the fixed work surface itself. While fixed work surface 14 of FIG. 1 may not require reinforcements the fixed work surface 14' of FIG. 3 has a narrower front strip 62 extending between monitor opening 18 and the rear edge 64 of adjustable work surface 52. Front flange 60' (FIG. 14) of the component support pan is rigidly affixed to the underside of strip 62 and reinforces this strip for support purposes.

Figure 2:
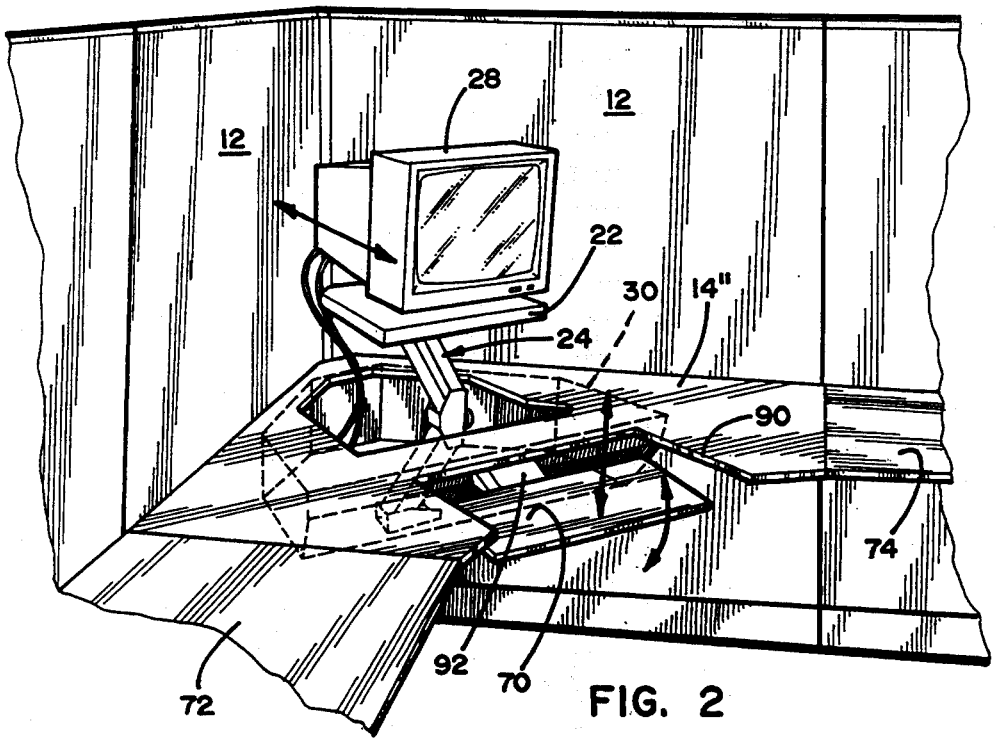
FIG. 2 is a pictorial perspective view showing a modified computer work station incorporating a movable keyboard support platform in addition to a raisable monitor platform.
Figure 3:
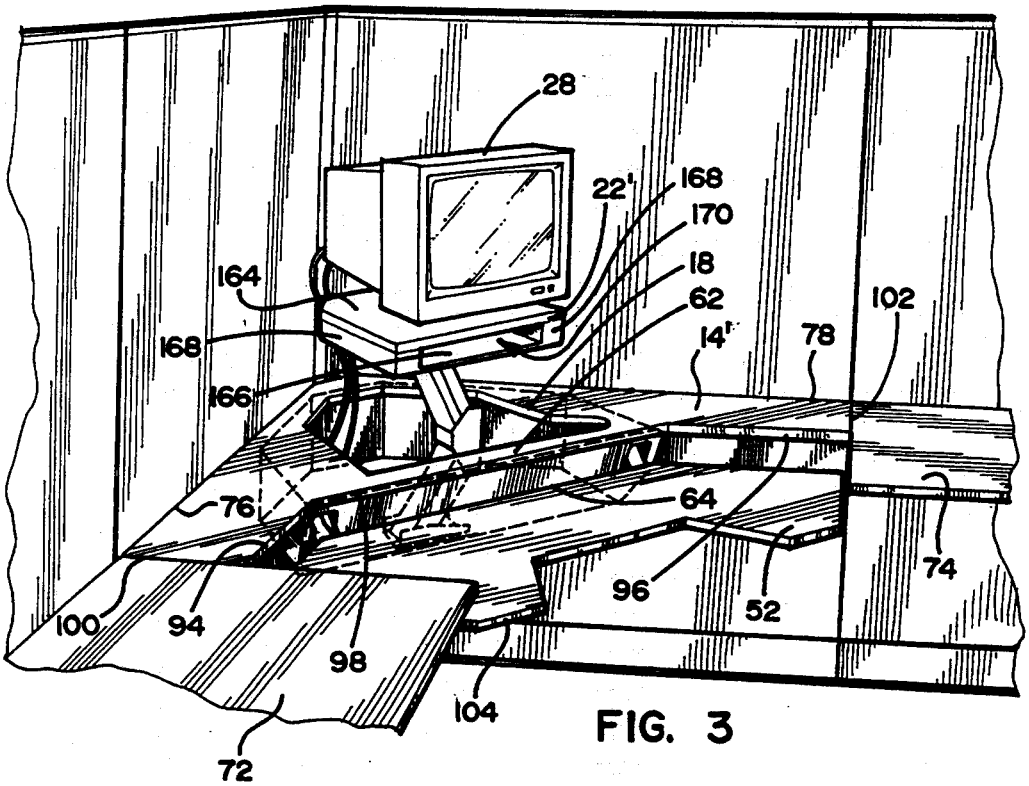
FIG. 3 is a pictorial perspective view showing a third embodiment of the present invention wherein the work station includes a movable desk top work surface in addition to an adjustable height monitor platform, and the monitor platform includes a lap top computer docking station.
Figure 4:
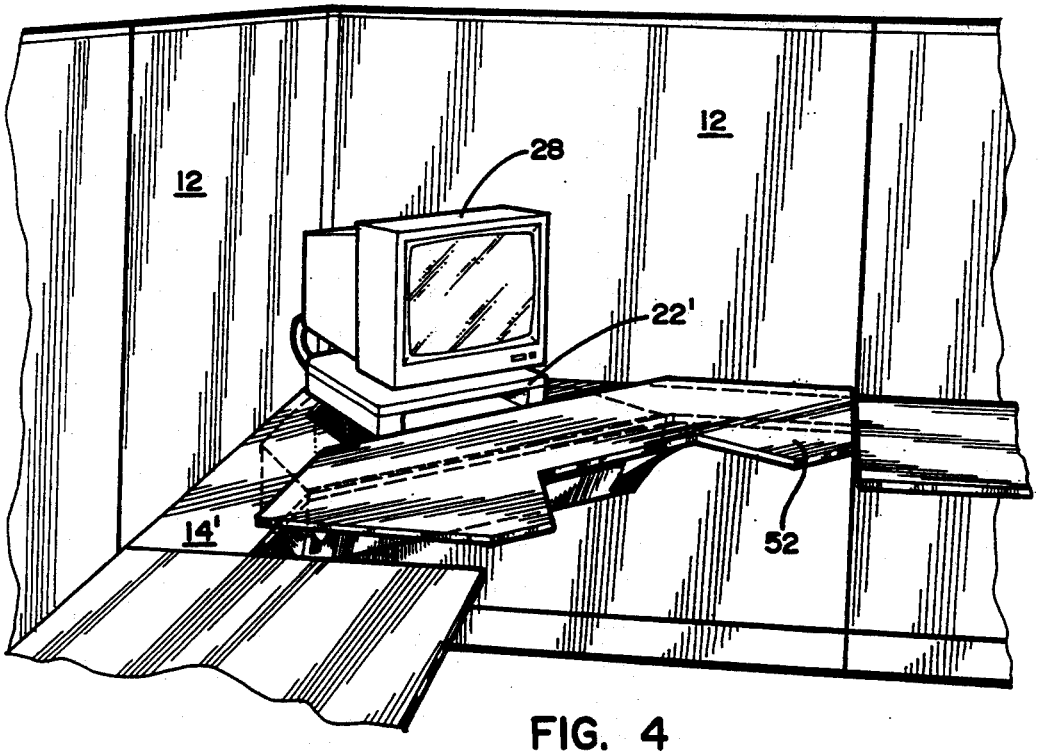
FIG. 4 is a pictorial perspective view showing the embodiment of FIG. 3 positioned at different monitor and work surface height adjustments.

As used herein the numeral 14 will be applied to all configurations of the fixed work surface in which a monitor opening 18 is formed with the numeral being primed to indicate different configurations of the fixed work surface to accommodate the movable work surfaces mounted at the front edge thereof. These include an adjustable desk top surface 52 as shown in FIG. 3 and an adjustable keyboard platform 70 as shown in FIG. 2. Fixed work surface 14' is shown in FIG. 3 while fixed work surface 14' is shown in FIG. 2.

The corner mounted nature of the work station of the present invention and the particular shape of the component support pan having a rectangular front configuration with a truncated triangular rear configuration provides maximum space usage for supporting a computer monitor. Computer monitors typically have a substantial front to rear depth. Placement of a monitor in a corner lets the monitor extend into the unused space in a corner while still providing usable work surface area at the front of the monitor within normal depth parameters of conventional panel mounted work surfaces 72 and 74 which abut perpendicularly the sides of the fixed work surface.

The shape of fixed work surface 14 is particularly adapted for corner mounting. The work surface has a generally rectangular shape with perpendicular back edges 76 and 78 abutting the corner of a room or a corner formed by perpendicular panels 12. Sidewalls 80 and 82 are perpendicular, respectively to sidewalls 76 and 78 and fit flushly against lateral work surface panel 72 and 74. In the embodiment of FIG. 1, a front edge 82 of work surface 14 extends at a 45 degree bevel angle with respect to sides 80 and 82, so that a computer user faces directly into the corner of the work space. A recess 84 extends inwardly toward the corner at the center of side 84 so as to permit a computer operator to position himself or herself closer to the computer monitor. Sides 86 on each side of recess 84 provide additional work surface space to the side of the operator.

In FIG. 2 fixed work surface 14' has substantially the same shape with the exception of the front edge of the work surface. The front edge of the work surface has an enlarged recess 90 that accommodates adjustable keyboard support platform 70 which is in turn mounted to the underside of fixed work surface 14' or preferably to component support pan 30 by means of an adjustable keyboard support mechanism 92. Adjustable keyboard support platforms and support mechanisms are conventional and permit vertical height adjustment of the keyboard support platform as well as pivotal movement of the keyboard support platform as shown by the directional arrows in FIG. 2.

Referring to FIG. 3 fixed work surface 14' again has the same outer configuration as fixed work surface 14 shown in FIG. 1 except that the front edge of work surface 14' is deeply recessed so that it has inclined side edges 94 and 96 that are parallel to rear edges 76 and 78 respectively. A center edge 98 extends at a 45 degree angle between edges 94 and 96 so as to form a thin strip 62 between monitor opening 18 and the front edge of fixed work surface 14'. Side edges 100 and 102 extend perpendicular to rear edges 76 and 78 a portion of the distance along work surfaces 72 and 74.

Adjustable work surface 52 constitutes an adjustable desk top surface that in essence fills in the rest of the space occupied by fixed desk top 14 of FIG. 1. Adjustable desk top work surface 52 has a front edge 104 which conforms essentially to the front edge of fixed work surface 14 of FIG. 1 with the side and rear edges of adjustable work surface 52 mating with the front edge of fixed work surface 14' and the sides of panels 72 and 74. While adjustable keyboard platform 70 and adjustable desk top work surface 52 both constitute adjustable work surfaces adjustable desk top surface 52 provides not only a keyboard platform but provides a work surface for general application, including writing and other desk top functions.

While the foregoing configurations of the fixed and adjustable work surfaces are preferred for a corner application other configurations could be employed.

An important feature of the monitor support mechanism 24 of the present invention is that it is a mechanical height adjustment mechanism that permits vertical height adjustment of the monitor platform simply by manually lifting and lowering the monitor platform by hand. While prior monitor platforms have permitted adjustment of the monitor by hydraulic lift cylinders, electric motors and mechanical screw mechanisms (all of which are complex and expensive) the present invention permits a manual adjustment of monitor height simply by lifting the mechanism up or pushing it down. The lift mechanism is an adjustable counterbalanced folding frame mechanism wherein a counter-balancing spring force neutralizes the weight of the computer monitor on the monitor platform. Thus the platform with monitor attached can be raised or lowered with slight manual pressure on the monitor platform and the monitor platform will remain exactly where it is placed. There is sufficient internal friction in the system to hold the monitor platform in place and to avoid being moved by slight unintended pressure on the monitor platform.

In the preferred practice of the present invention the monitor lift mechanism is a pivoting or folding elbow type of mechanism comprising of a pair of pivoting arms 110 (best shown in FIG. 8) that are pivotally connected together at a joint 112. Arms 110 each comprise a pair of members 114 connected together in parallelogram fashion so that monitor platform 22 remains horizontal as the platform is raised and lowered. The opposite corners of the parallelogram formed by members 114 are interconnected by a counterbalance spring 116 (shown schematically in FIG. 8) which counterbalances the downward force of monitor 28. An adjustment mechanism 118 makes it possible to adjust the tension of spring 116 in order to balance the weight of a particular monitor.

Figure 8:
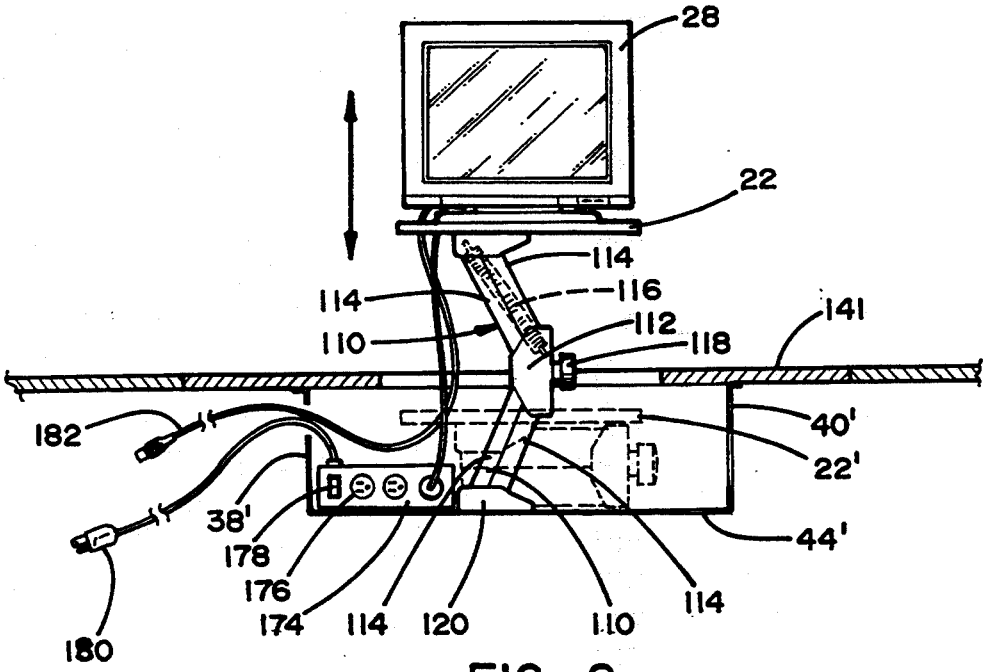
FIG. 8 is a sectional front elevational view taken along lines 8—8 of FIG. 7, showing the incorporation of electrical outlets and communications outlets in the interior of the component pan.
Figure 15:
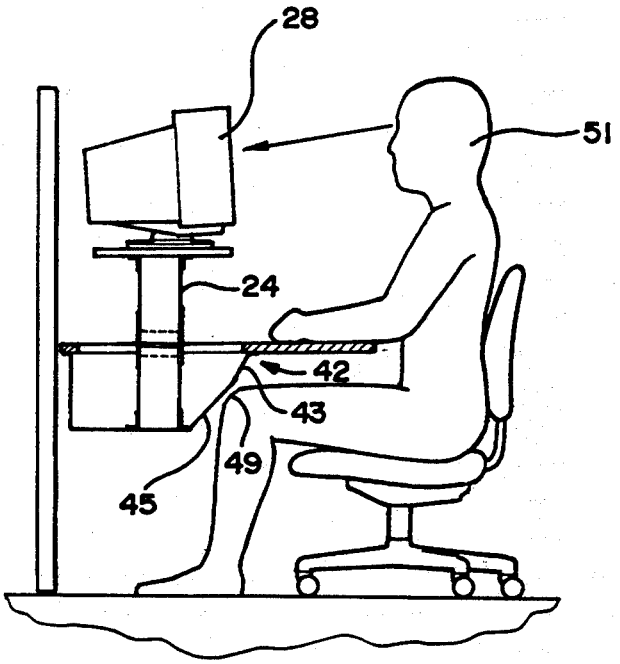
FIG. 15 is a sectional side view showing the work station in used with the monitor platform raised to an elevated position.
Figure 16:
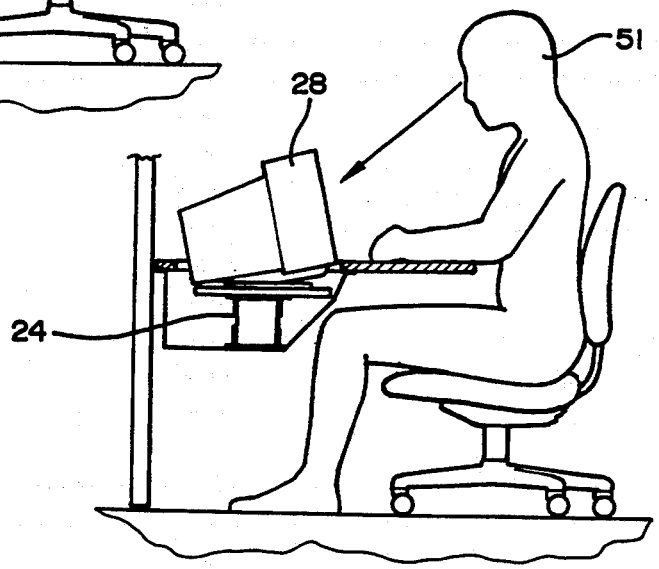
FIG. 16 is a view as shown in FIG. 15 with the monitor platform lowered to a position below the fixed work surface, as shown in FIG, 6.

As shown in FIGS. 8, 15 and 16 monitor platform 22 can be raised by hand to a raised position well above the surface of fixed work surface 14 or it can be lowered to a lowered position 22' (shown in phantom in FIG. 8) wherein the monitor platform lies well below the level of work surface 14 (see also FIG. 6). A base 120 of the monitor support mechanism is supported by and attached to the bottom of the component pan.

Figure 17:
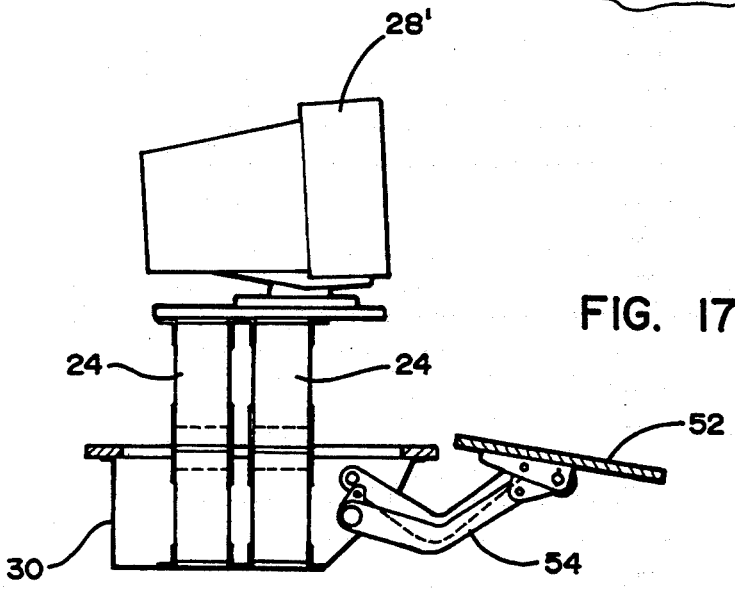
FIG. 17 is a fifth embodiment of the present invention that is particularly designed for supporting extra heavy or extra large monitors of the type used for computer aided drafting, wherein two monitor lift mechanisms are employed to raise and lower the monitor platform under counterbalanced conditions.

For a conventional computer monitor a single monitor support mechanism is sufficient to permit easy adjustment and to counterbalance the weight of the monitor. For heavy computer monitors such as large computer monitors used for computer aided drafting and design a single monitor support mechanism may not be adequate. A mechanism for supporting a large computer monitor 28' is shown in FIG. 17. In this case two monitor support mechanisms 24 are employed side by side in the component support pan. These permit the use of a large computer monitor 28' that is as much as twice the weight of a conventional computer monitor.

The type of spring counterbalanced elbow type monitor support mechanism that has been found to work satisfactorily in the context of the present invention is a unit commercially available from Weber Knapp Company. Another type of pivoting link or folding frame support mechanism that could be employed is a scissors type of mechanism 240, shown in FIG. 25 This uses a counterbalance spring 242 to counterbalance the weight of a monitor This construction is discussed in more detail below.

Figure 5:
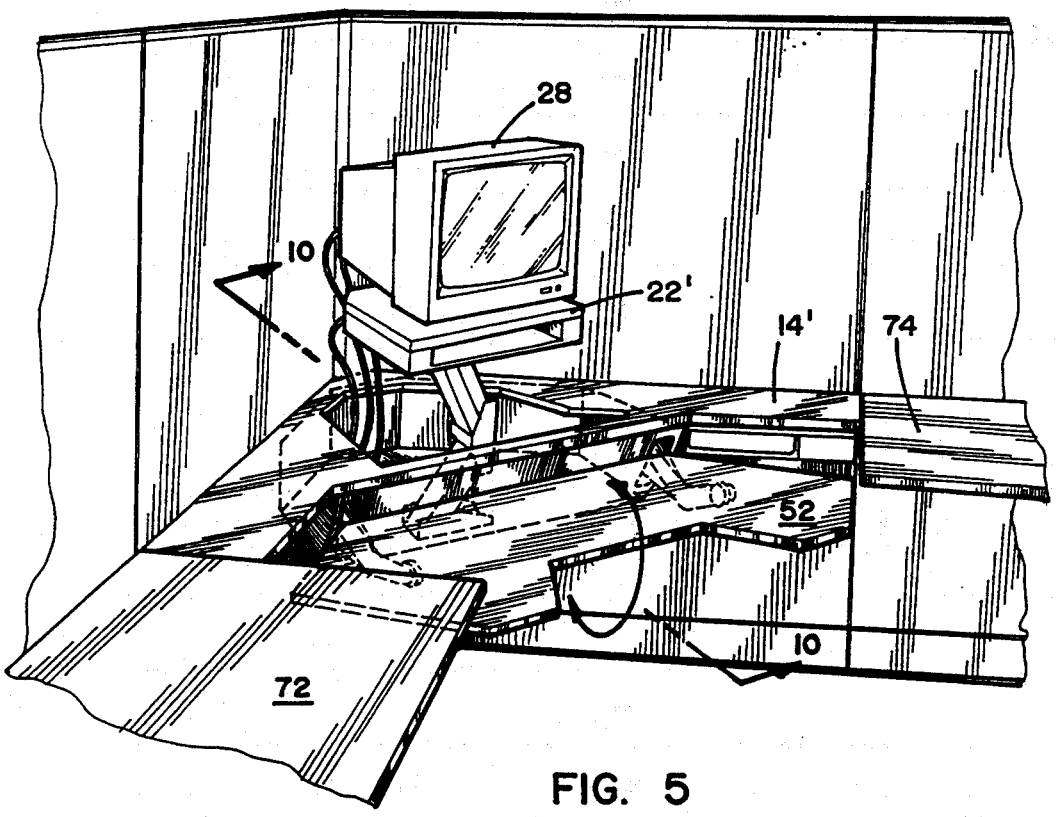
FIG. 5 a pictorial perspective view showing the embodiment of FIG. 3 wherein the movable desk top work surface incorporates a tilt mechanism in addition to a height adjustment mechanism.
Figure 10:
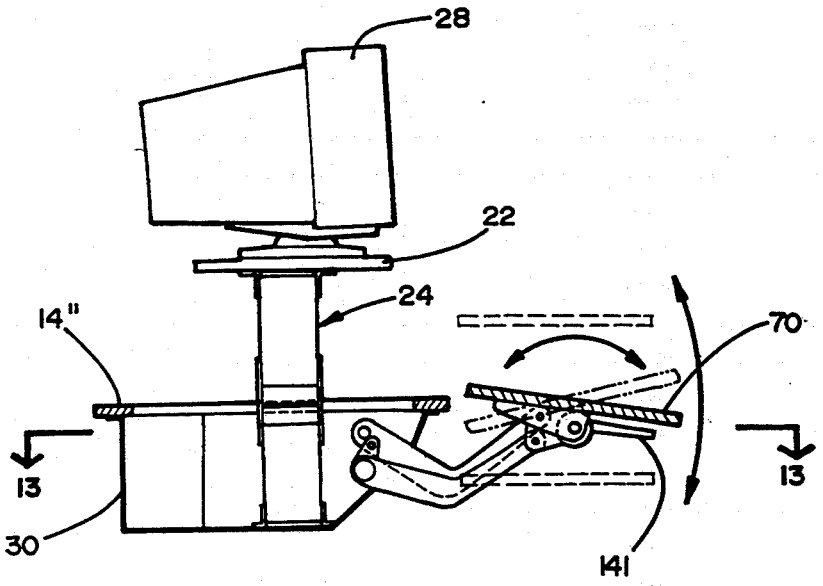
FIG. 10 is a sectional side elevational view taken along lines 9—9 of FIG. 7.
Figure 11:
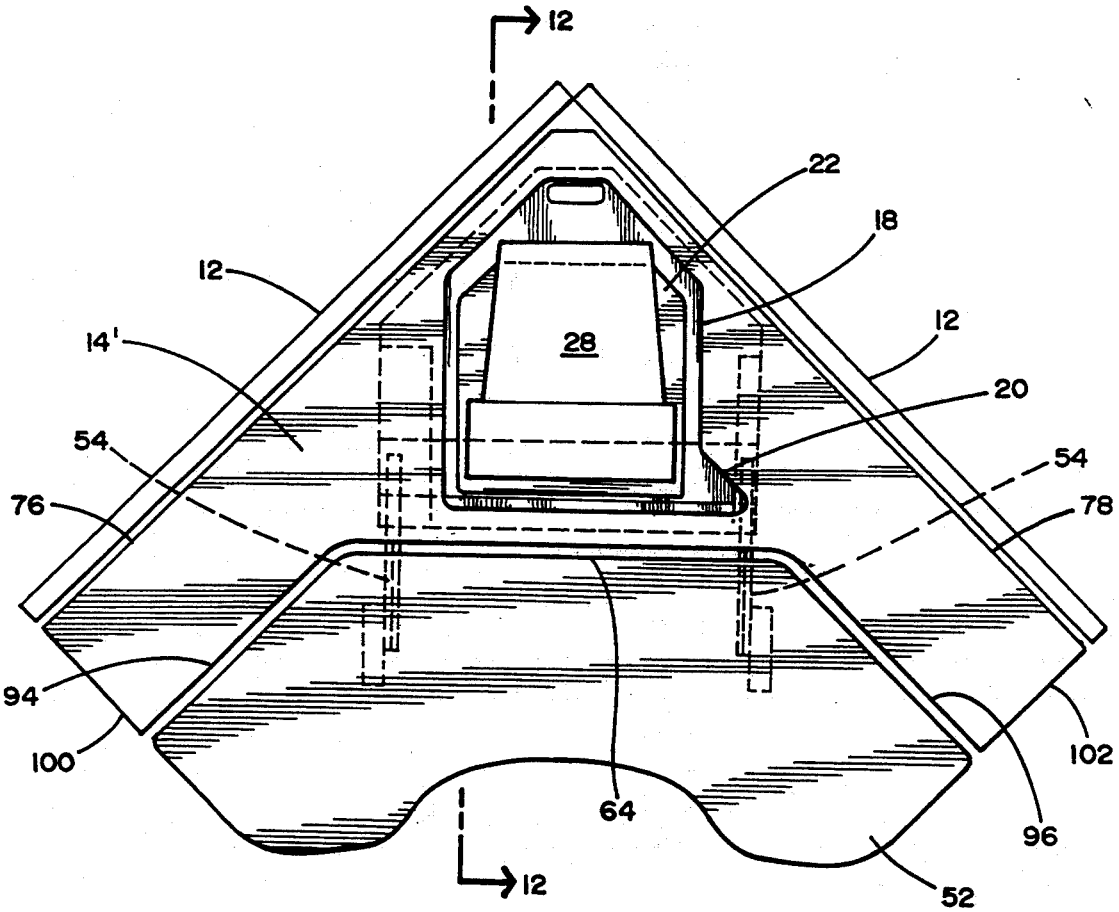
FIG. 11 is a plan view of the corner mounted work station of the present invention employing an adjustable desk top work surface with a contoured front edge.

The hinged support mechanism employed for mounting the adjustable desk top type work surface to the pan is shown in FIG. 14. Each cantilever bracket 54 comprises a pair of parallelogram arms 126 and 128 at each side of the front edge of component support pan 30. A bracket 130 is attached at a front or outer end of the these arms. An adjustment mechanism 132 can be manually adjusted to control the inclination or tilt of the work surfaced so that the work surface can be inclined, as shown in FIG. 5 or 10. A torsion rod 134 rigidly interconnects the arms at each side of the component support pan in order to insure that the arms on each side of the pan remain parallel at all times. The torsion rod 134 is positioned inside the pan so that it does not interfere with the computer operator or present undesirable exposed pinch points.

An important feature of the adjustable work surface support mechanism is that the support arms are not mounted to the underside of the work surface, where screws can pull out under vertical pressure, especially when the surface is wood or the like. Rather, the adjustable work surface support mechanism is rigidly mounted by a support bracket 136 to the rigid metal side walls 38 and 40 of the component support pan by screws or rivets 140 or the like. This provides a vertical rigid mounting surface and insures that the adjustable work surface support arms remain parallel and is throughout the life of the support mechanism. All of these features, including a spring counterbalance mechanism 142, are mounted inside the component support pan, away from dust, dirt, and other interference and preventing the operator from being damaged by exposed pinch points. This entire mechanism can be produced as an integral unit and attached to the underside of the fixed work surface. A release latch 141 (shown schematically in FIG. 10) locks the adjustable work surface in any desired position. The latch can be manually unlocked to permit adjustment of the height or inclination of the work surface. Mechanisms of this type are known.

Figure 9:
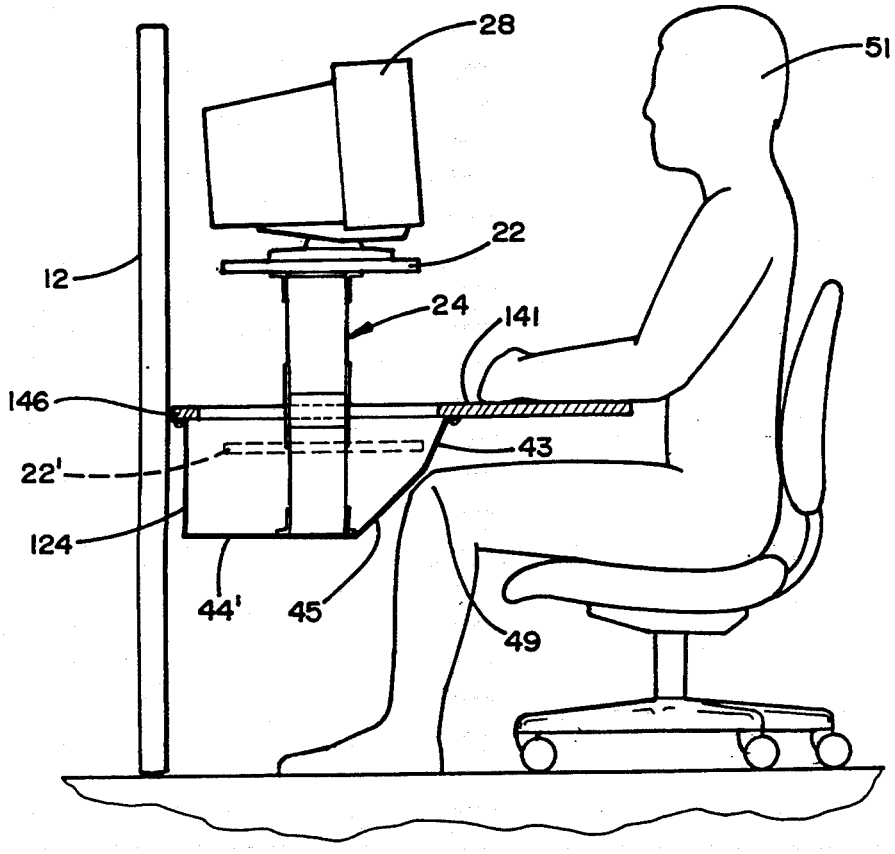
Figure 13:
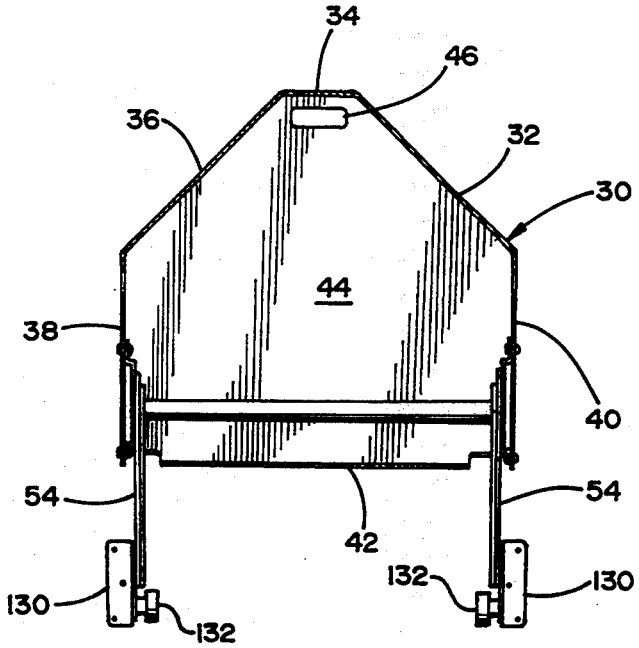
FIG. 13 is a sectional view taken along lines 13—13 of FIG. 12, showing only the pan and work surface support structure .

When the pan is employed for a corner mounted work station, the shape of the pan is as shown in FIGS. 13 and 14 with a truncated triangular rear portion and a three sided rectangular front portion. The depth of the pan is desirably 6 to 12 inches and preferably 9 inches and the pan is substantially wider than the monitor opening in the work surface. This provides ample room in the pan for lowering the monitor to a partially recessed position as shown in FIG. 6 while still providing plenty of room in the pan for additional electronic components. Most of the side walls of the pan are straight vertical members, but the front wall of the pan has a modified configuration to provide knee room for the computer operator. As shown in FIG. 9 the front wall has an upper section 43 that extends downwardly from the top of the pan and then has a more sharply beveled section 45 that angles rearwardly until it joins bottom of the pan. Beveled section 45 provides room for the knees 49 of operator 51.

Figure 7:
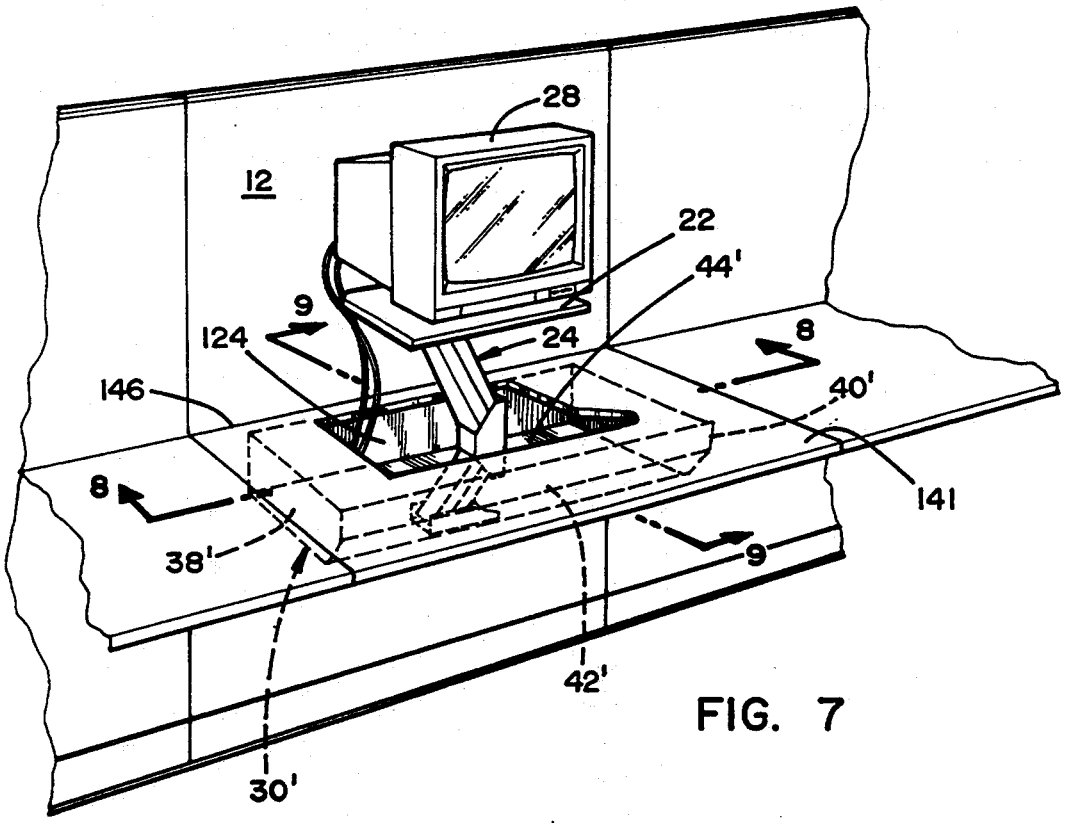
FIG. 7 is another embodiment of the present invention, wherein the component pan has a rectangular configuration and is mounted on a side wall of a wall panel system as opposed to the corner mounting of the embodiments of FIGS. 1–6.

While the work station of the present invention desirably is configured for corner placement with the unique pan structure described above, the work station can be configured for placement against a side wall, as shown in FIGS. 7–9. In this configuration, the work surface is rectangular and has a straight back edge 146 which is parallel to side panel 120 A fixed work surface 141 is mounted in a conventional manner on a panel 12 of a panel system In this system pan 30' has front and side walls 42', 38' and 40' respectively, which can be substantially the same as corner pan 30. Bottom 44' is rectangular and rear wall 124 extends parallel to panel 12. The beveled front wall of the side mounted system is substantially the same as the beveled front wall of the corner mounted system, so the illustration in FIG. 9 is representative of the front of both component support pans.

In addition to the panel mounted systems represented by the corner system of FIG. 1 and the side wall system of FIG. 7 the work surface also can be mounted on legs 16 as described above and shown in FIGS. 18–20. Legs 16 comprise elongated feet 150 that engage the ground and telescoping upright portions 152 that extend upwardly to the fixed work surface and are securely attached to opposite sides of the component support pan for supporting the work surface and pan of the work station. Telescoping legs 152 comprise an upper section 153 and a lower section 155 that extends within a recess in upper section 153. A conventional mechanical motorized pneumatic or hydraulic drive mechanism 156 is shown schematically in FIGS. 19 and 20 for raising and lowering the work surface by telescoping the legs. Drive mechanisms of this type are conventional so details are not shown. This embodiment is shown in perspective in FIG. 18. In this embodiment, the height of the pan and fixed work surface can be adjusted by adjusting telescoping legs 152. All of the other features discussed above, including the adjustable work surface 52 and the raisable monitor platform 22 can be the same as in the other embodiments. Desirably the free standing unit is a corner unit as shown in FIG. 18 although a rectangular unit adapted for side wall mounting can be employed.

Figure 12:
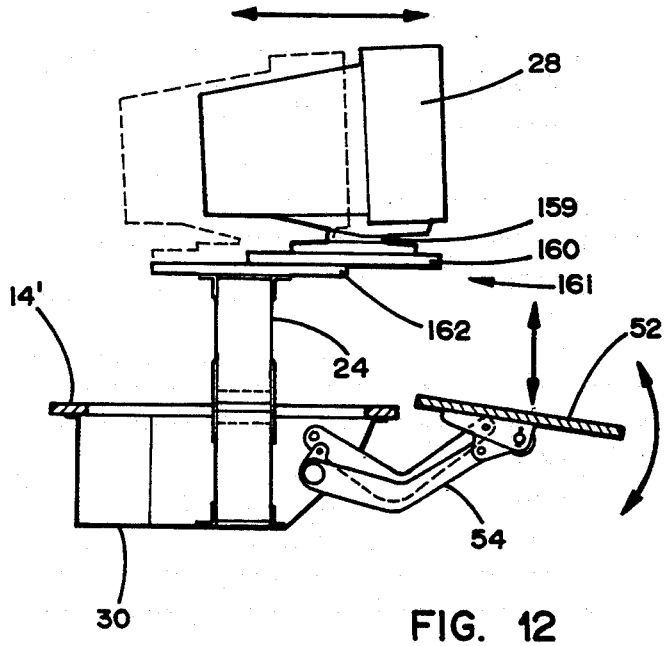
FIG. 12 is a sectional view taken along lines 12—12 of FIG. 11 showing in addition the forward and rearward monitor position adjustment of the present invention incorporated into the monitor platform.

The monitor support platform 22 provides vertical support for the monitor. Typically the monitor will have its own tilt/swivel mounting 159 (FIG. 12) so it is not necessary to incorporate a tilt/swivel mounting in the monitor platforms although this is of course feasible. The monitor platform does preferably incorporate a slide mechanism 161 for sliding the monitor forwardly and rearwardly on the monitor platform in the direction shown in FIG. 2. This is shown in more detail in FIG. 12 wherein an upper plate 160 is mounted to a lower member 162 that incorporates a slide mechanism (such as a drawer slide mechanism) which permits upper plate 160 to slide forwardly and rearwardly on plate 162, which is fixed to the upper end of the monitor lift mechanism 24. A number of different types of slide mechanisms can be employed to provide forward and rearward sliding movement of the monitor on the monitor platform.

Another feature that can be incorporated into the monitor platform is a computer docking station for a lap top computer or the like A monitor platform 22' of this nature is shown in FIGS. 3-6. Monitor platform 22' has an upper platform member 164 and a lower platform member 166 spaced vertically apart from the upper platform member by side walls 168, leaving a rectangular opening or docking chamber 170 in the interior of the monitor platform. This can be shaped so that a lap top computer can be placed in the opening. Electronic terminal members can be mounted in the back of the chamber 170 so that the lap top computer will automatically be connected to the desk top computer circuitry and monitor when the lap top unit is plugged into the docking station. The lap top computer can either function as the main computer for the desk top operation or it can serve as an auxiliary device or be used to transfer information back and forth to existing desk top computer circuitry.

An important feature of the present invention is that the component support pan serves not only to support a computer and computer platform, but it provides rigid structural support for the work surfaces and also provides concealed storage space for electronic wiring and computer components themselves. As shown in FIG. 8, an outlet housing 174 can incorporate electrical outlets 176 as well as a surge suppressor and master switch or circuit breaker 178. An electrical outlet cord 180 can extend through any one of the several openings in the pan for connection to an appropriate power outlet. A video outlet cord from the monitor can similarly be routed through the same opening to computer components located outside the pan. Communications terminals can also be mounted in the pan.

Figure 21:
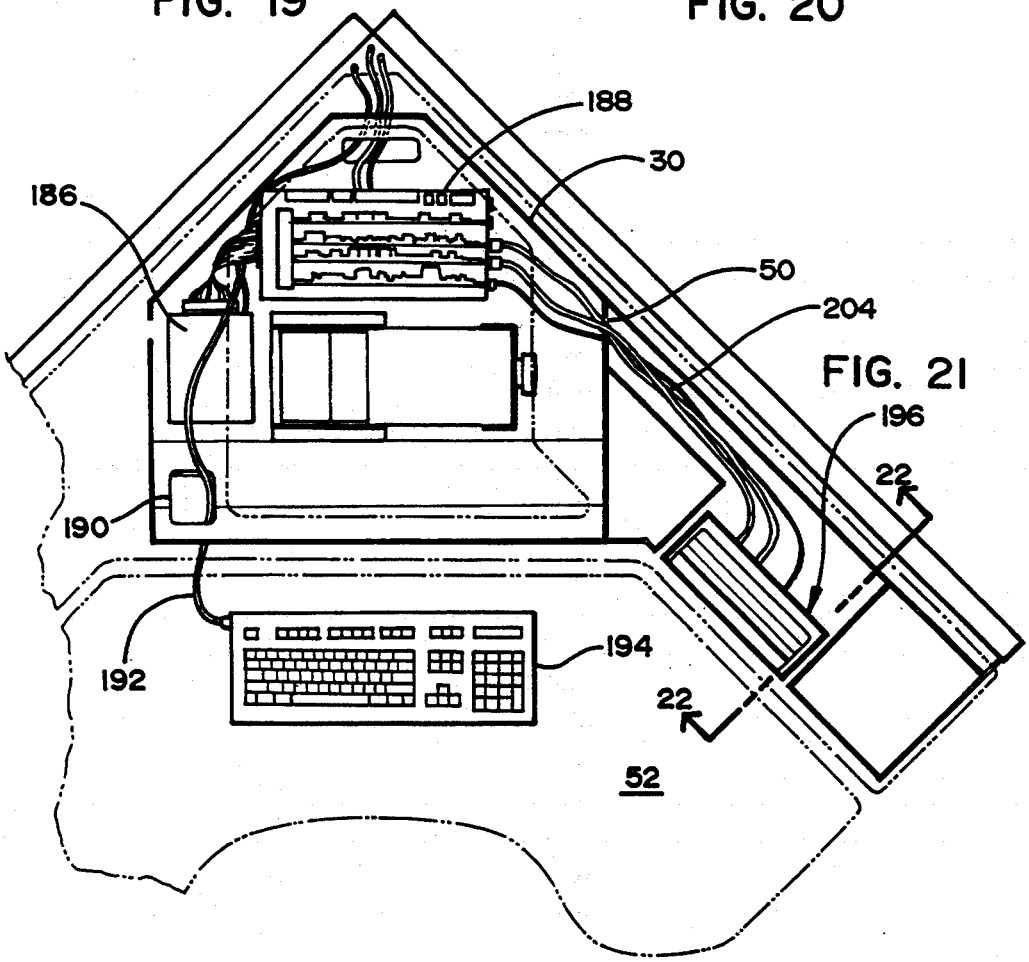
FIG. 21 is a plan view of a panel mounted corner work station showing the incorporation of additional computer components in the interior of the component pan and showing the incorporation of a lap top computer docking station alongside the component pan.
Figure 23:
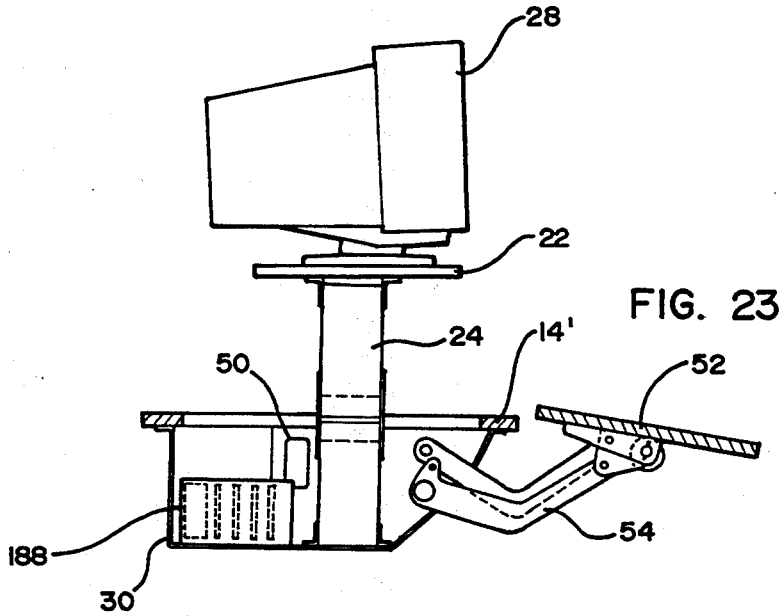
FIG. 23 is a cross sectional side view of the present invention, showing the incorporation of a computer CPU or expansion chassis in the interior of the component pan.

As shown in FIGS 21 and 23, other computer components can be located in the pan as well. An expansion chassis 186 as well as a central processing unit 188 can be located entirely within the interior of the component support pan, with the expansion chassis mounted on the side and the central processing unit 188 being mounted to the rear of the pan in the illustrative embodiment shown in FIG. 21. The pan can provide additional side or bottom wall openings 190 to convey additional wiring such as keyboard wiring 192 to a keyboard 194, which can be placed on the desk top adjustable work surface 52 or on a keyboard platform type of adjustable work surface of the type shown in FIG. 2. A keyboard could also be placed on a non-adjustable work surface such as shown in FIG. 1.

A pan formed of metal provides desirable rigidity and reinforcement as well as electrical isolation for electrical components. However, a pan formed of a substantially rigid thermoplastic or thermosetting resin or composite material also could be employed.

Figure 22:
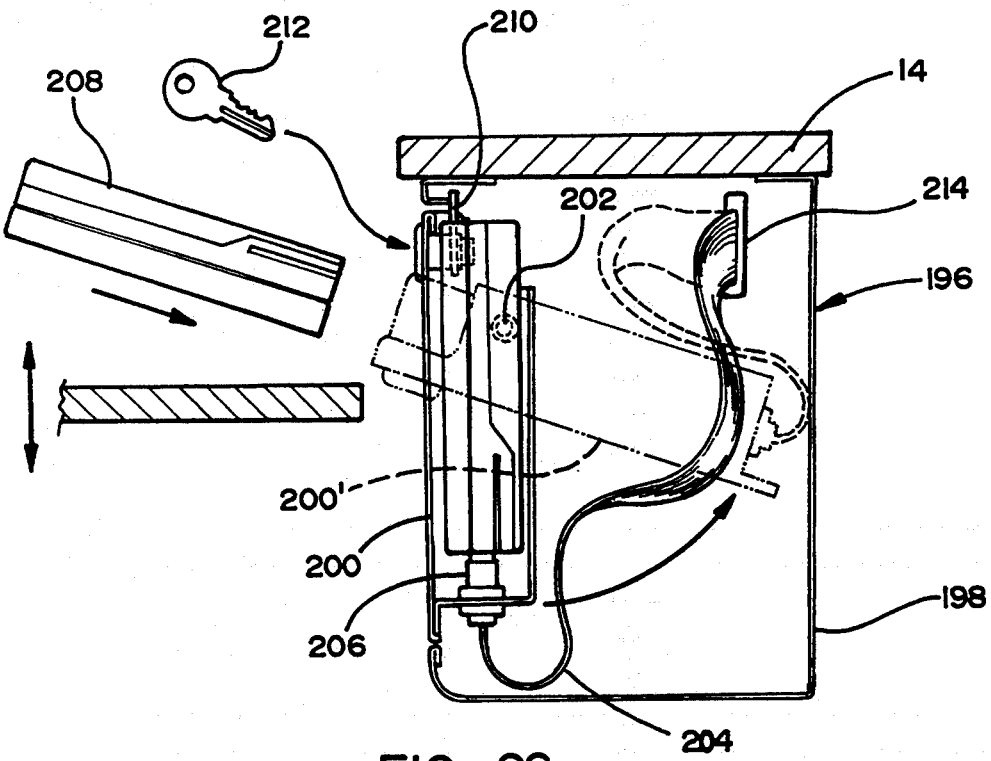
FIG. 22 is a cross sectional view taken along lines 22—22 of FIG. 21.

Another feature of the present invention is a separate lap top docking station 196 which is shown in FIGS. 21 and 22. Docking station 196 comprises a housing 198 mounted on the underside of work surface 14 at a front edge thereof and to the side of any adjustable work surface. Housing 198 is rectangular in shape and has a lap top docking station 200 pivotally mounted on side pivot pins 202 at the front of the housing. Docking station 200 includes wiring 204 and terminals 206 mounted at the bottom of the docking station and the docking station pivots between a closed position represented by element 200 and an open position represented in phantom by element 200'. When the docking station is open a lap top computer module 208 that is designed for use with a docking station can be inserted downwardly into the docking station, where it automatically mates with and becomes connected to the computer terminals 206. The docking station can then be closed and locked by a latch 210 which is operated by a key 212 for security purposes. Small lap top units or computer units that are designed to work with docking stations can easily be stolen, and this provides a safe receptacle for such units while still making the units connectable to the computer station incorporated into the work station. The wiring 204 connects it from the housing 198 by outlet opening 214 and, as shown in FIG. 21 can extend along the rear of the panel away from any operator visibility or contact through opening 50 in the pan for connection to central processing unit 188. This provides a convenient means for handling the docking and undocking of computer systems while keeping virtually all of the computer components except for the monitor accessible but out of sight beneath the work surface area.

Figure 24:
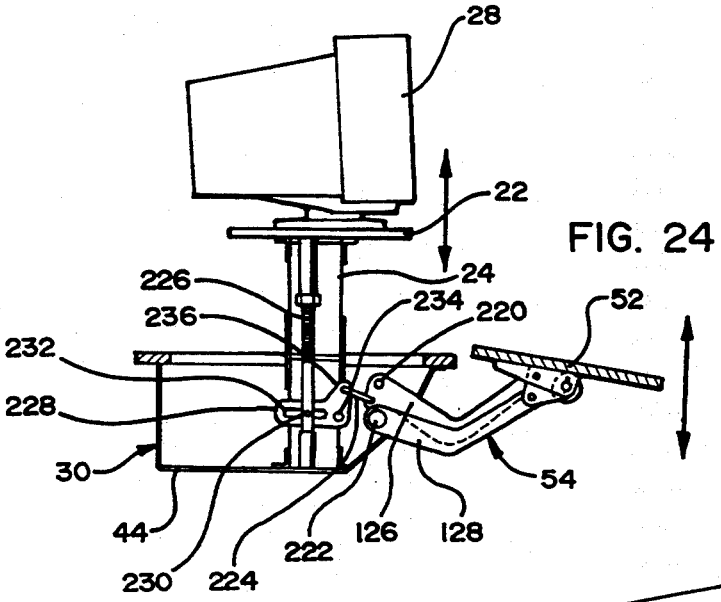
FIG. 24 is a cross sectional side view of another embodiment of the present invention, wherein the apparatus includes linkage between the keyboard or movable work surface platform and the monitor lift mechanism whereby the monitor is automatically raised or lowered simultaneously with the vertical height adjustment of the keyboard or movable work surface.
Figure 25:
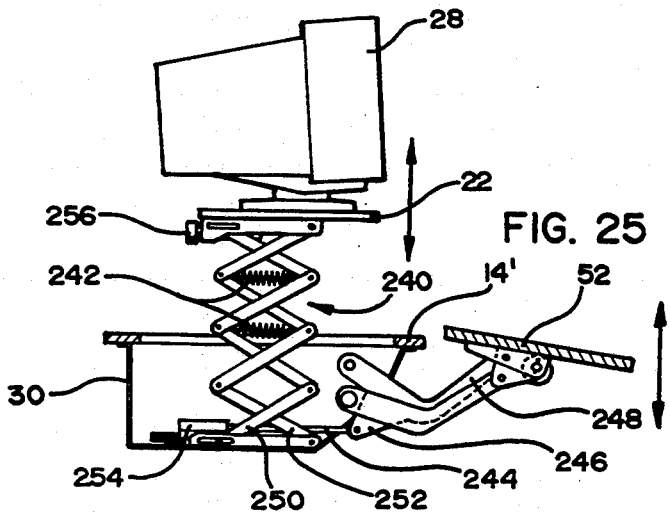
FIG. 25 is a schematic cross sectional side elevational view similar to FIG. 24 wherein an X-shaped scissors mechanism is employed as a monitor lift mechanism instead of the lift mechanism with two pivoting arms that is shown in the other figures.

Another feature of the present invention is shown in FIGS. 24 and 25. While the system can be designed to provide independent adjustment capabilities for the monitor and keyboard in some circumstances it may be desired to provide for linked adjustment of the monitor and keyboard at the same time, so that when a keyboard is lowered the monitor is automatically lowered at the same time. And, conversely when the keyboard or monitor is raised, the other component is simultaneously raised along with it. FIG. 24, one type of a linked mechanism is shown. As in previous embodiments monitor 28 is mounted on monitor platform 22 which is in turn mounted on lift mechanism 24 which is mounted in the bottom 44 of pan 30 Similarly adjustable work surface 52 is mounted on cantilever brackets 54 comprising arms 126 and 128 at each side of the support pan Arms 126 and 128 are pivoted respectfully about pins 220 and 222 mounted to the side of pan 30. An offset portion of arm 126 spaced away from pivot access 220 is rigidly connected to a link 224.

Link 224 is connected to corresponding linkage attached to the monitor support platform such that when work surface 52 is raised or lowered the monitor support platform is correspondingly raised or lowered, This monitor platform linkage includes a telescoping drive rod 226 connected at an upper end to monitor platform 22. The drive rod is threaded and can be telescoped independently by rotating one rod so as to provide independent adjustment of the monitor with respect to the height of the work surface 52. This provides an independent adjustment means. Drive rod 226 is drivingly engaged to link 224 by link 228. Link 228 is driven vertically by rod 226 by a pin 230 in rod 226 that extends into a horizontal slot 232 in link 228. Link 228 is pivotally mounted to fixed pivot pin 234 and link 224 is attached to an eccentric portion 236 of the link.

In operation of the mechanism of FIG. 24 when the work surface 52 is pushed down link 224 causes link 228 to pivot counter clockwise and this lowers rod 226 and monitor platform 222. The converse happens when the work surface or monitor platform is raised.

While other linkages will work to accomplish these objectives, the foregoing represents one way to accomplish an interlinked movement of the monitor platform at the same time as the adjustable work surface while at the same time providing adjustment means for adjusting the relative vertical positions of the monitor platform and the work surface.

Another type of linked movement of the work surface and monitor platform is shown in connection with a different type of monitor lift mechanism in FIG. 25. In this embodiment lift mechanism 240 is a scissors type of lifting mechanism which is spring biased to counterbalance the weight of the monitor by springs 242 connected between opposite vertices of the X-shaped scissors frame. A link 244 connected to an offset portion 246 of arm 248 engages one of the legs 250 of the scissors frame and draws the end of that leg toward and away from a stationary end of leg 252. This causes the scissors frame to extend and retract in a conventional manner. The height of the monitor can be independently adjusted with respect to the adjustable work surface 52 by an adjustment mechanism 254 shown schematically which permits adjustment of the position of link 244 with respect to the end of leg 250 of the scissors frame. An adjustment mechanism 256 could also be incorporated at the upper end of the scissors frame.

It should be understood that the foregoing is merely illustrative of the preferred practice of the present invention and that various modifications and changes can be made in the embodiments disclosed herein without departing from the spirit and scope of the present invention which is defined in the appended claims

I claim:

1. A computer work station comprising:

a fixed work surface having a monitor opening therein;

mounting means for supporting the fixed work surface at a raised elevation above a floor;

a monitor platform that is positioned over the monitor opening and at least partially covers the monitor opening;

a component support pan mounted on the underside of the work surface below the monitor opening, the pan having downwardly extending sidewalls and a bottom enclosing lower ends of the sidewalls, the pan having an open top the pan serving as a recessed and concealed housing for wiring and computer components;

a monitor lift mechanism mounted in the pan and having an extendible upper end that fits through the monitor opening and is mounted to the monitor support platform the lift mechanism being vertically movable to raise and lower the monitor lift platform.

2. A computer work station according to claim 1 wherein the pan extends at least about six inches below the work surface and at least some of the side walls are positioned outwardly from the edges of the monitor opening.

3. A computer work station according to claim 1 wherein the pan is formed of sheet metal and is attached to the underside of the work surface by fasteners that extend through openings in horizontal flanges at upper edges of the pan sidewalls.

4. A computer work station according to claim 1 wherein the work station comprises an adjustable work surface mounted at a front side of the fixed work surface, an adjustable height support mechanism for the adjustable work surface being mounted to the pan.

5. A computer work station according to claim 4 wherein the support mechanism for the adjustable work surface is mounted in the interior of the pan, the support mechanism being connected to the adjustable work surface by cantilever bracket members that extend through spaced openings in the pan the support mechanism including torsion cross member means in interconnecting the cantilever bracket members inside the pan for maintaining the bracket members in parallel relationship.

6. A computer work station according to claim 4 wherein the support for the adjustable work surface is linked to the monitor lift mechanism such that when one of the monitor platform and the adjustable work surface is raised or lowered, the other of the monitor platform and the adjustable work surface is raised or lowered accordingly.

7. A computer work station according to claim 6 and further including adjustment means for adjusting the relative height of the monitor platform with respect to the adjustable work surface.

8. A computer work station according to claim 1 wherein the work station is shaped to fit in a corner, with a rear side being formed in the shape of a right angle that fits in a corner and a front side positioned to face into the corner the pan also having a rear side that is shaped to fit in the corner.

9. A computer work station according to claim 1 wherein the monitor lift mechanism comprises an extendible folding frame that is spring counterbalanced to offset the weight of a computer monitor placed on the monitor platform and is adjustable for monitors of different weight, such that the monitor platform can be raised or lowered by manually lifting or depressing the monitor platform and the platform remains where it is positioned until further adjustment.

10. A computer work station according to claim 1 wherein the monitor platform includes a docking station for a lap top computer the docking station including a receptacle for a lap top computer and electrical connections to the receptacle that connect the lap top computer to other computer components at the work station.

11. A computer work station according to claim 1 wherein the pan includes a front sidewall running along a front side of the fixed work surface the front sidewall having a rearwardly inclined lower portion that provides additional knee room for a work station operator.

12. A computer work station according to claim 1 wherein the monitor platform includes adjustment means for adjusting the monitor position in a forward and rearward horizontal direction.

13. A computer work station according to claim 1 and further comprising a lap top computer docking station mounted on the underside of the fixed work surface, the docking station including a pivoting lap top docking receptacle having an open position wherein a dockable lap top computer can be inserted into the receptacle, and a closed positions wherein the lap top computer is enclosed in the docking station and is not removable therefrom, the docking station including electrical terminal means for connecting the lap top computer to other computer components at the work station when the lap top computer is inserted in the docking system.

14. A computer work station according to claim 1 wherein the monitor platform is formed to fit through the monitor opening in the fixed work surface and the monitor opening is large enough so that a monitor also will fit at least partially through the opening the monitor lift mechanism being capable of lowering to a lowered position wherein the monitor platform is below the level of the fixed work surface, such that a monitor on the monitor platform is partially recessed in the pan when the lift mechanism is in its lowered position.

15. A computer work station according to claim 1 wherein the work surface support structure comprises a pair of support legs attached to opposite sides of the pan and extending downwardly to the floor, the legs telescoping to raise and lower the fixed work surface.

16. A computer work station comprising:

a fixed work surface supported by a work surface support structure at a raised elevation above a floor, the work surface having a monitor opening therein of sufficient size that a computer monitor can fit therethrough;

an open topped component pan mounted on the underside of the work surface below the monitor opening, the monitor pan including sidewalls that extend downwardly at least six inches from the underside of the work surface and a bottom that extends between the lower edges of the sidewalls the pan being affixed to the underside of the work surface at upper edges of the sidewalls such that the pan provides reinforcement for the work surface;

a monitor platform that at least partially covers the monitor opening;

a vertically adjustable monitor support mechanism mounted in the pan and having an extendable upper end mounted to and supporting the monitor platform, the support mechanism including a counterbalancing mechanism that offsets the weight of a monitor on the monitor platforms such that the monitor height can be adjusted by manually raising and lowering the monitor platform, the monitor remaining in the adjusted position until the position is re-adjusted.

17. A computer work station according to claim 16 wherein the sidewalls extend six to twelve inches below the fixed work surface and at least some of the sidewalls are positioned outwardly from the edges of the monitor opening.

18. A computer work station according to claim 17 wherein the sidewalls extend about nine inches below the fixed work surface

19. A computer work station comprising:

a fixed work surface shaped to fit in a corner the work surface having a generally rectangular configuration with one corner beveled at an angle, the beveled corner forming the front of the work surface and the corner opposite to the beveled corner fitting in a corner formed by perpendicular wall members, such that an operator working at the front of the work surface faces into the corner, the work surface having a monitor opening therein;

work surface support means for supporting the work surface at an elevated position above a floor;

a component support pan mounted under the work surface below the monitor opening, the pan including side walls that extend downwardly from the work surface and a bottom that extends between bottom edges of the side walls;

a monitor platform that supports a computer monitor a monitor lift mechanism mounted in the pan and having a raisable upper end that is extendible upwardly through the monitor opening in the work surface, the monitor platform being mounted on the upper end of the monitor lift mechanism and being vertically adjustable thereby, the lift mechanism comprising a foldable support frame that is counterbalanced to offset the weight of a computer monitor placed on the monitor platform such that the monitor platform and monitor remain in the same vertical position until an operator manually moves the platform upwardly or downwardly.

20. A computer works station according to claim 19 and further comprising an adjustable work surface adjustably mounted at a front side of the fixed work surface, the adjustable work surface being mounted on spaced arms that are pivotally mounted to opposite sidewalls of the pan in the interior thereof cross member means extending between the arms inside the pan for retaining the arms in parallel supporting relationship.

21. A computer work station according to claim 19 wherein a computer central processing unit is mounted in the pan and is connected by wiring to a keyboard on the adjustable work surface and to a monitor on the monitor platform.

22. A computer work station according to claim 20 wherein the adjustable work surface is a desk top surface extending across the front of the fixed work surface and including a recessed center position such that outer sides of the desk top surface extend partially around the side of an operator positioned in the recessed center position.

23. A computer work station according to claim 19 and further comprising a keyboard support platform mounted to the pan at a front side thereof by an adjustable keyboard support mechanism.

* * * * *

UNITED STATES PATENT AND TRADEMARK OFFICE

CERTIFICATE OF CORRECTION

PATENT NO. : 5,437,235

DATED : August 1, 1995

INVENTOR(S) : Travis M. Randolph

It is certified that error appears in the above-identified patent and that said Letters Patent is hereby corrected as shown below:

Column 1, line 59, insert -- , -- after the word "terminals" and after the word "outlets".

Column 2, line 14, after the word "position", insert -- . --;
line 24, insert the word -- in -- after the word "invention";
line 58, the words "FIG. 10" should be -- FIG. 9 --.

Column 3, line 7, the word "used" should be -- use --;
line 11, the words "FIG, 6" should be -- FIG. 6 --;
line 61, the word "a" should be -- as --;
line 66, the word "truncate" should be -- truncated --.

Column 4, line 30, the numbers "32 34 36, 38 40" should read -- 32, 34, 36, 38, 40, --;
line 47, the word "pang" should be -- pan --;
line 58, after the number "14", insert -- . --.

Column 5, line 30, the number "14'" should be -- 14'' --;
line 60, the number "14'" should be -- 14'' --;
line 65, the number "14'" should be -- 14'' --.

Column 7, line 27, after the number "25", insert -- . --;
line 29, after the word "monitor", insert -- . --.

Column 8, line 28, the number "120" should be -- 12 --;
line 30, after the word "system", (1st occurrence) insert -- . --;
lines 50-51, the words "mechanical motorized pneumatic" should be -- mechanical, motorized, pneumatic, --.

Column 9, line 17, after the word "like", insert -- . --.

Column 10, line 44, before the word "FIG.", insert the word -- In --;
line 48, after the number "30", insert -- . --;
line 50, after the word "pan", insert -- . --;
line 58, the word "lowered," should be -- lowered. --.

Column 11, line 55, after the word "top", insert -- , --;
line 61, after the word "platform", insert -- , --.

Column 12, line 16, after the word "pan", insert -- , --;
line 17, delete the word "in" before the word "interconnecting";
line 36, after the word "corner", insert -- , --;
line 49, after the word "computer", insert -- , --;
line 56, after the word "surface", insert -- , --.

UNITED STATES PATENT AND TRADEMARK OFFICE

CERTIFICATE OF CORRECTION

PATENT NO. : 5,437,235

DATED : August 1, 1995

INVENTOR(S) : Travis M. Randolph

It is certified that error appears in the above-identified patent and that said Letters Patent is hereby corrected as shown below:

Column 13, line 1, the word "positions" should be -- position --;
line 13, after the word "opening", insert -- , --;
line 36, after the word "sidewalls", insert -- , --;
line 49, the word "platforms" should be -- platform, --.
Column 14, line 5, after the word "corner", insert -- , --;
line 21, after the words "computer monitor", insert -- ; --;
line 30, after the word "platform", insert -- , --;
line 34, the word "works" should be -- work --;
line 39, after the word "thereof", insert -- , --.
Column 5, line 64, after the number "70" insert -- , --;
Column 10, line 57, after the word "lowered" insert -- , --

Signed and Sealed this

Fourteenth Day of November, 1995

Bruce Lehman

*Attest:*

BRUCE LEHMAN

*Attesting Officer*

*Commissioner of Patents and Trademarks*